US006017199A

United States Patent [19]

Yanaka

[11] Patent Number: 6,017,199

[45] Date of Patent: Jan. 25, 2000

[54] DIAPHRAGM CARBURETOR FOR FOUR CYCLE ENGINES

[75] Inventor: Yuzuru Yanaka, Iwate-ken, Japan

[73] Assignee: U.S.A. Zama, Inc., Franklin, Ind.

[21] Appl. No.: 09/081,923

[22] Filed: May 20, 1998

[51] Int. Cl.[7] ..... F04B 43/06; F04B 17/05; F02M 37/12

[52] U.S. Cl. ..... 417/395; 417/380; 123/DIG. 5

[58] Field of Search ..... 417/380, 395; 123/73 C, 509, DIG. 5; 261/35

[56] References Cited

U.S. PATENT DOCUMENTS

| | | | |
|---|---|---|---|
| 4,168,288 | 9/1979 | Nau et al. | 417/395 |
| 4,846,119 | 7/1989 | Geyer et al. | 417/395 |
| 5,259,352 | 11/1993 | Gerhardy et al. | 417/395 |
| 5,365,893 | 11/1994 | Wissmann et al. | 123/DIG. 5 |
| 5,419,686 | 5/1995 | Wissmann et al. | 417/395 |

FOREIGN PATENT DOCUMENTS

| | | | |
|---|---|---|---|
| 185671 | 8/1986 | Japan | 417/395 |
| 307340 | 11/1994 | Japan | 417/395 |

*Primary Examiner*—Willis R. Wolfe
*Attorney, Agent, or Firm*—Lyon & Lyon LLP

[57] ABSTRACT

A diaphragm type carburetor is disclosed wherein a cantilever portion is used to augment the resilience of a first diaphragm and return it to an undeformed position during the neutral signal produced by a 4-cycle engine. The cantilever portion cooperates with the intermittent vacuum signal from the crankcase piped to one side of the first diaphragm so as to oscillate the diaphragm and draw fuel from the fuel tank of the engine into the carburetor. The device is also suited for use with 2-cycle engines which produce both vacuum and pressure pulses wherein the cantilever portion is used to augment either pulse to improve the performance of the fuel diaphragm.

12 Claims, 3 Drawing Sheets

DIAPHRAGM CARBURETOR FOR FOUR CYCLE ENGINES

FIELD OF THE INVENTION

The present invention relates to fuel pumps for two-stroke and four-stroke engines. More particularly, the present invention relates to devices and methods for improving the performance and durability of a fuel pump diaphragm in four-stroke engine carburetors.

BACKGROUND OF THE INVENTION

Most small engine applications today require the use of two-stroke or four-stroke engines. In a four-stroke engine, the cycle of the engine is completed in two revolutions of the engine crankshaft. The first stroke of the cycle is the inlet stroke, followed by the compression stroke, the power stroke, and then the exhaust stroke. In contrast, two-stroke engines perform the compression and power stroke of the four-stroke cycle at the same time as the inlet and exhaust strokes, respectively thus requiring only one revolution of the engine crankshaft.

The different mechanical aspects of a two-stroke versus a four-stroke engine have dictated differing constructions in the carburetors of prior engines. For example, two-stroke engines typically use a diaphragm-type fuel pump to supply fuel to the engine. The use of a fuel pump is required for multiple position use of the engine to assure constant fuel supply to the engine. In two-stroke engines, the diaphragm fuel pump is actuated by an air pulse signal created in the crankcase by the revolution of the engine. A pressure pulse is created on the "down" stroke of the engine piston and a corresponding vacuum pulse is created on the "up" stroke of the engine piston. The pressure and vacuum pulse is then fed from the crankcase to the fuel pump, causing oscillation of the fuel pump diaphragm, thus drawing fuel from the engine fuel tank to a constant fuel chamber and then into the air intake passage. Upon entry into the air intake passage, the fuel is atomized and mixed with air to be fed into the engine cylinder for firing.

Although effective with two-stroke configurations, diaphragm-type fuel pumps have not proved as effective for four-stroke engine applications. A four-stroke engine does not have a pressure/vacuum signal in the crankcase capable of driving a diaphragm-type fuel pump. Most four-stroke engines instead take the vacuum signal originating in the air intake passage and feed this signal to one side of the diaphragm. There is no corresponding pressure signal to cause oscillation of the diaphragm pump; the diaphragm is instead subjected to a neutral pressure signal followed by a vacuum signal. The neutral pressure signal in conjunction with the vacuum signal from the air intake passage is not sufficient by themselves to create oscillation of the diaphragm. Without sufficient oscillation of the diaphragm, the fuel pump cannot effectively draw fuel from the fuel tank into the carburetor system.

An alternate means is thus necessary in four-stroke applications to drive the pump and provide the required fuel for starting and normal operation of the engine. Instead of providing a pressure signal to the fuel pump diaphragm, four-stroke engines are configured with a coil spring device (see FIG. 1) to aid in the return of the diaphragm to the neutral position during the neutral time of the engine cycle. Although this configuration is not as effective as the plus-minus signal present in two-stroke engines, it has generally been the only means available to drive diaphragm-type fuel pumps.

A number of problems have been encountered in traditional coil spring fuel diaphragms. The use of a vacuum/spring arrangement to drive the fuel pump is not desirable because it results in increased wear on the diaphragm structure. The coil spring is in constant frictional contact with the material of the diaphragm during engine operation. Fuel pump diaphragms are weakened by a combination of degradation from contact with fuel and frictional contact from the spring coil return means, often resulting in torn, damaged, or otherwise ineffective diaphragms which must be repaired or replaced. In order to combat the wear problem caused by the use of a spring return, prior fuel diaphragms were often made of rubber which is sturdier and more wear resistant than many of the available materials suitable to this application. However, the use of rubber has become less desirable as it is a material that is not suited for use with the more advanced alcohol fuels now being used in two-cycle and four-cycle engines. Alcohol quickly degrades rubber, again causing breakdown and tearing of the diaphragm and additional expense and delay is caused by having to repair or replace the damaged diaphragm.

In order to prevent premature breakdown and tearing of the diaphragm caused by exposure to alcohol, a more alcohol-resistant material such as MYLAR™, PETP or LUMIRROR™ can be chosen. Although these materials prevent the breakdown of the diaphragm due to alcohol exposure, they are considerably less wear resistant than rubber and wear out more quickly from the action of the spring.

It can be seen that a number of unique problems have been encountered in the design and construction of diaphragm-type fuel pumps for four-cycle engines. Prior art diaphragms which purport to overcome these problems have been unable to provide the wear resistant qualities required by the use of a spring return mechanism with the alcohol resistant qualities mandated by today's alcohol fuels.

It would thus be desirable to provide a diaphragm-type fuel carburetor which simply and effectively eliminates the aforementioned difficulties. The fuel pump would preferably eliminate the necessity for a high-wear spring arrangement which requires the use of rubber diaphragm to provide sufficient wear resistance. It would be desirable to have a diaphragmtype fuel pump for small engine applications which can be made from alcohol resistant materials such as polyethylene terephthalate (PETP), MYLAR™ or LUMIRROR™. The fuel pump should also provide a stronger, more stable fuel pressure than provided by a spring-type fuel pump diaphragm.

An improved diaphragm-type fuel pump should preferably be suitable for use with small engines having a fuel pump as an integral part of the carburetor as well as for engines having a fuel pump that is a separate assembly from the carburetor. Such a device should also be suitable for both two-stroke and four-stroke engines. It would be desirable for an improved diaphragm-type carburetor to meet the above objectives and goals without adding significant complication or expense to the carburetor assembly.

SUMMARY OF THE INVENTION

A preferred embodiment of the present invention comprises a conventional fuel pump having a first pump diaphragm. The coil spring return mechanism of prior art devices is replaced by a cantilever portion overlaid over the first diaphragm. The cantilever portion is shaped to aid in the elastic return of the diaphragm to a pre-determined geometry following physical deformation of the first pump diaphragm wherein the deformation is caused by a pressure or vacuum signal piped to one side of the diaphragm.

A preferred embodiment is disclosed in which the cantilever portion comprises a pumping section integrally formed within the cantilever portion such that the cantilever portion aids in the elastic return of the first diaphragm during the neutral signal of the engine cycle. In another embodiment, the cantilever portion is a single cantilever arm which is formed of a second piece of stiff, resilient material which is then bonded or fastened to the first diaphragm. The additional stiffness provided by the second piece of material is sufficient to aid in the elastic return of the first diaphragm during the neutral signal of the engine cycle.

Embodiments of the invention are disclosed which are suitable for both two-cycle and four-cycle engine applications. In particular, a device constructed in accordance with the present invention is disclosed which can be used for two-cycle applications when it is desired to augment the performance of the diaphragm when either the pressure or vacuum signal is relatively weak in relation to the contrasting signal. Another embodiment is disclosed wherein a device of the present invention is used as a substitute for the pressure signal in four-cycle applications when there is no corresponding pressure signal to offset the vacuum signal piped to one side of the first diaphragm.

Other embodiments of the invention utilize a number of advanced materials for construction of the first diaphragm and cantilever portions which offer significant benefits over prior art diaphragms. Appropriate materials disclosed which offer sufficient elastic properties to resist deformation and can be fashioned to have an inherent shape memory, including MYLAR™ and LUMIRROR™.

A preferred embodiment is disclosed wherein the device of the present invention is configured to be used with a fuel pump which is integrally formed within the carburetor assembly. Embodiments of the present invention are disclosed which are also suitable for applications wherein the diaphragm-type fuel pumps are a separate structure from the carburetor assembly. The teachings of the present invention are universally applicable to fuel pump devices having a diaphragm assembly therein for creating a pulse signal suitable.

DETAILED DESCRIPTION OF THE DRAWINGS

The device of the present invention will be described with appropriate reference to the attached drawings.

Figure 1:
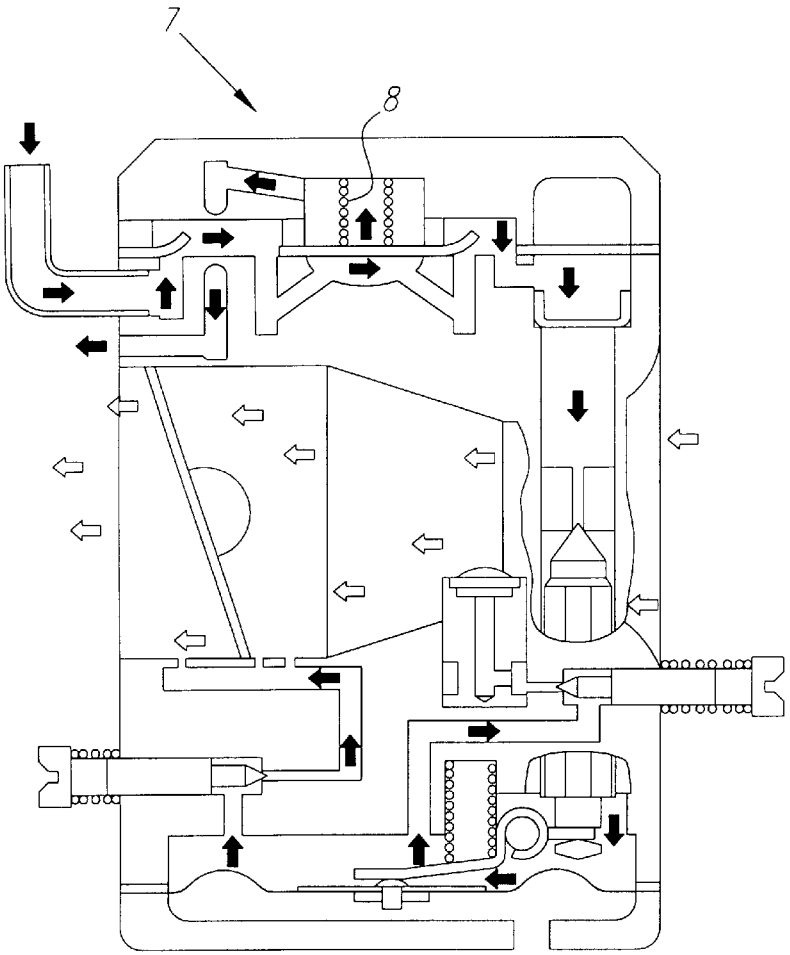
FIG. 1 (PRIOR ART)
FIG. 1 is a cut-away view of a prior art carburetor and fuel pump assembly.

FIG. 1 depicts a typical prior art carburetor and fuel pump assembly. A diaphragm-type carburetor is equipped with a diaphragm-type fuel pump driven by pulse pressure generated in the crankcase of the engine. A vacuum pulse signal is in communication with the fuel pump via a pulse introduction port 14 which causes the diaphragm 13 to be flex inward so that the spring 8 is compressed. During the neutral signal of the engine cycle, the spring 8 returns to its expanded configuration pushing the diaphragm 13 from its upwardly flexed position. The oscillation caused by the cooperation of the vacuum pulse and the spring 8 cause the fuel to be sucked through the fuel introduction passage 10, past the second side 25 of the first diaphragm 13 and into the fuel passage 24 where it is metered into the constant-fuel chamber 28 via a fuel valve 26. From the constant-fuel chamber 28, fuel is preferably drawn into the air intake passage from a main nozzle 15 located in the narrowest part of the venturi 19, past throttle nozzles 17*b* and 17*c* located upstream of the throttle valve 16 and an idle nozzle 17*a* located downstream of the throttle valve 16.

Figure 2:
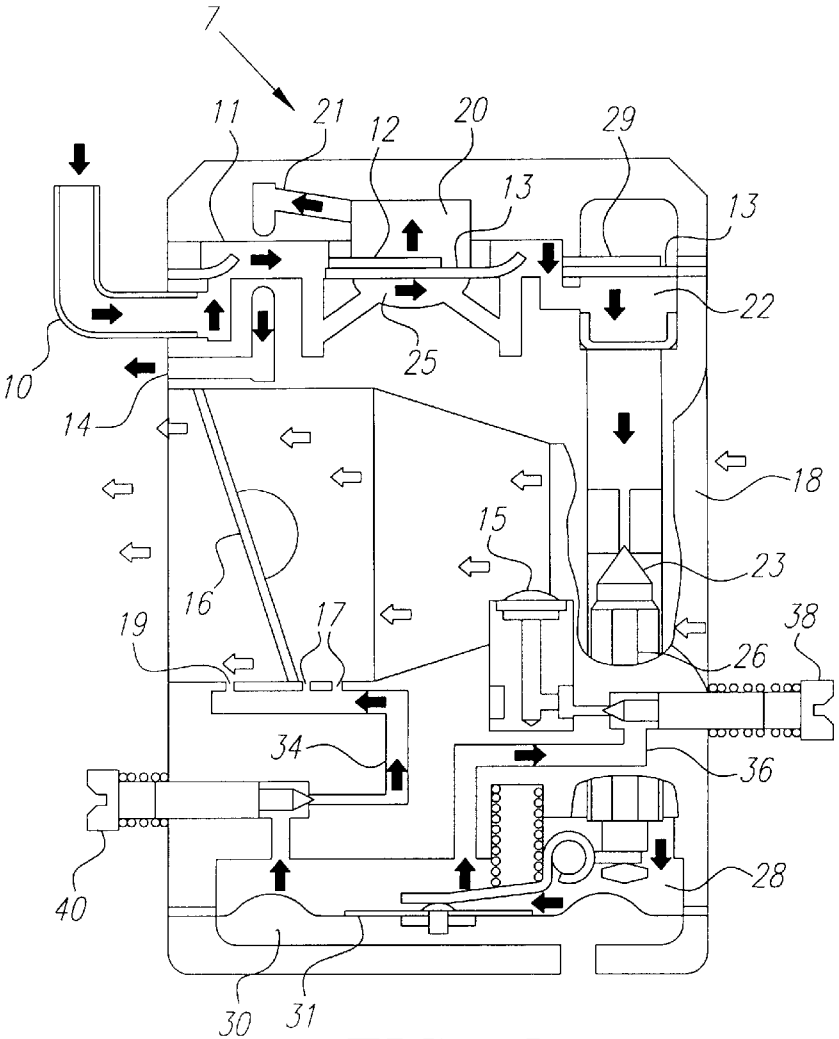
FIG. 2 is a cut-away view of a carburetor with a fuel pump assembly constructed according to the teachings of the present invention.

FIG. 2 shows a fuel pump assembly constructed according to the teachings of the present invention. Referring to FIG. 2, in order for fuel to enter the fuel introduction tube 10, an oscillation must be established in the first fuel diaphragm 13 and cantilever portion 12 fuel diaphragms. In order to accomplish this, an intake vacuum pulse is piped from a pulse introduction port 14 through a pulse path 21 to one side 20 of the fuel diaphragm, causing the first diaphragm 13 and cantilever portion 12 to bow inward toward the source of the pulse.

Figure 4A:
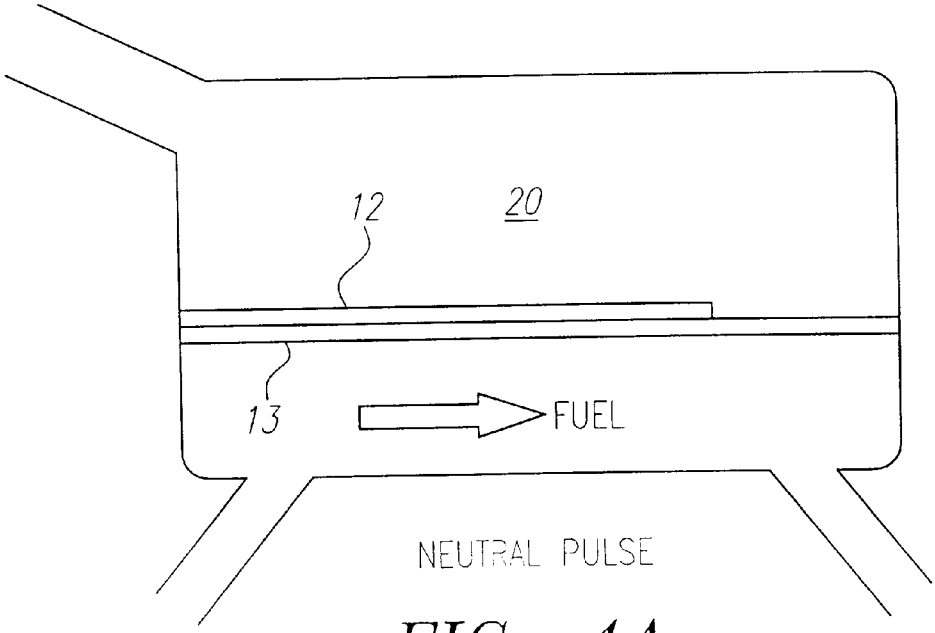
FIG. 4A is a cut away view of the fuel pump diaphragm during the "neutral" pressure signal.
Figure 4B:
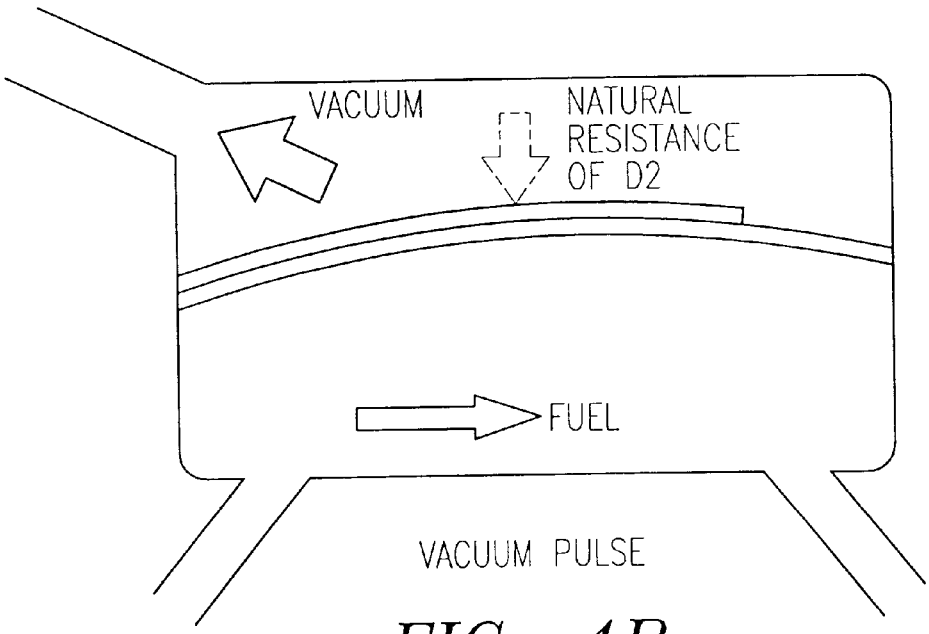
FIG. 4B is a cut away view of the fuel pump during the "vacuum" pressure signal.

As in prior systems, the vacuum pulse provided to side 20 of first diaphragm 13 and cantilever portion 12 is cyclic in character and will occur in time with the cycling of the engine. FIG. 4A shows the first diaphragm 13 and cantilever portion 12 when the pulse signal is "off." As shown in FIG. 4A, side 20 of first diaphragm 13 and cantilever portion 12 has no signal, or a "neutral" signal. During this neutral signal, the cantilever portion 12 has sufficient resilience to return both diaphragms 12 and 13 to their original position. The next successive vacuum pulse signal will overcome the natural resilience of the first diaphragm 13 and cantilever portion 12 diaphragms and cause an inward bow toward the source of the vacuum as shown in FIG. 4B. Again, the cantilever portion 12 has sufficient resilience to return the first diaphragm 13 and cantilever portion 12 to their original positions during the subsequent neutral signal. The resultant effect is to cause oscillation in the first diaphragm13 and cantilever portion 12 having the same frequency as the cycling of the engine.

It can be appreciated that an important design consideration is the degree of resilience with which the first diaphragm 13 and cantilever portion 12 resist the upward pull of the vacuum signal from the crankcase. The resilience of the device must be such that it can return the first diaphragm 13 to its original position during the neutral signal of the vacuum pulse yet not so resilient that it will overcome the vacuum pulse and prevent the deformation of the diaphragm during the vacuum pulse. A material such as LUMIRROR™, available from Toray Company, Toray Bldg., 2-1, Nihonbashi-Muromachi 2-chome, Chuo-ku, Tokyo 103-8666, Japan; Polyethylene Terephthalate (PETP); or MYLAR™, available from DuPont Packaging and Industrial Polymers, D-5100 1007 Market Street, Wilmington, DE 19898, MYLAR™, has been found to work well for this application when configured in accordance with the teachings of this invention. In addition, a thickness of about 0.188–0.2 mm has been found to be effective for small engine applications such as chainsaws, trimmers, and other hand-held devices. However, the device of the present invention has been found to work effectively with a thickness of up to about 0.3 mm for small engine applications. The device of the present invention will work equally well with larger engine applications that require a diaphragm that is considerably larger and thicker than the specifications noted herein.

Once that oscillation is established in the first diaphragm 13 and cantilever portion 12, fuel is caused to be sucked into the fuel introduction tube 10 and along the fuel passage 11 as seen best in FIG. 2. The fuel is drawn along the fuel passage on the second side 25 of the first diaphragm 13 and cantilever portion 12 and then into fuel passage 24. A fuel valve 26 opens and closes the fuel passage 24 in accordance with the displacement of the diaphragm 31 so that a prescribed amount of fuel is held at a constant pressure in the constant-fuel chamber 28. Fuel is then sucked through first 36 and second 34 constant fuel passages, through first 38 and second 40 metering valves and into either the narrowest part of venturi 19 through full throttle port 15 or directly into the air passage 18 through idle port 17*a* located downstream of the throttle valve 16, or part throttle ports 17*a* and 17*b* located upstream of the throttle valve.

Figure 3:
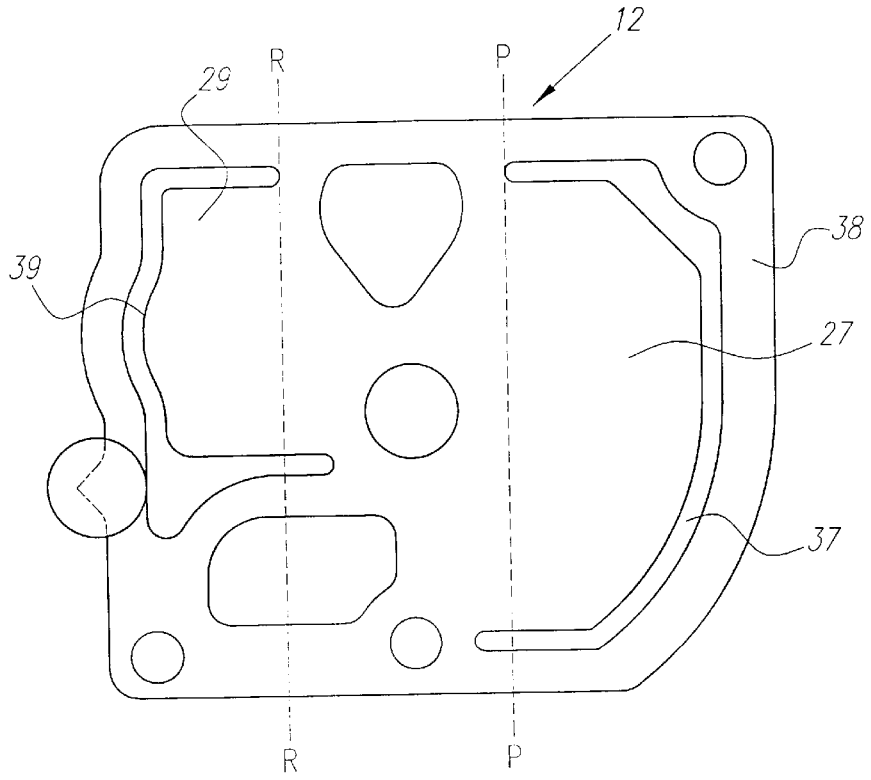
FIG. 3 is a view of a fuel pump diaphragm constructed according to the teachings of the present invention.

Turning to FIG. 3, additional details of the device of the present invention will be described. The invention comprises a cantilever portion 12 which is overlaid over the first diaphragm 13 to augment the elastic characteristics of the first diaphragm. The cantilever portion 12 can be fabricated from a number of flexible materials, but it is preferred to use a material which is both durable and resistant to material breakdown caused by exposure to fuel and alcohol.

The critical need of prior art diaphragms to use wear resistant materials in the construction of the diaphragm is eliminated in the device of the present invention. In particular, the lack of frictional contact between the cantilever portion and the diaphragm allows the use of less durable materials which are more resistant to alcohol or which are more naturally elastic and have superior shape memory qualities than rubber. Frictional contact is eliminated in the device of the present invention because there is little movement of the cantilever portion 12 return mechanism in relation to the diaphragm surface as is present in a traditional system. The cantilever portion 12 and the first diaphragm 13 are disposed in facing engagement. During oscillation of the prior art spring/diaphragm arrangement, the spring would prematurely wear the diaphragm because of the movement of the diaphragm relative to the spring.

The cantilever portion 12 is configured with a cutout 37 so that a cantilever arm section 27 is created. The section 27 is free on three sides and is configured so that it may partially rotate about line P—P in FIG. 3. The material of the cantilever portion is such that the cantilever arm section 27 resists being displaced from the plane of the fixed portion 38 of the cantilever portion and will tend to return to the same plane as the fixed portion. The section 27 rests on top of the fuel pumping portion of the first diaphragm (not shown) and flexes in one direction with the first diaphragm 13 during the vacuum pulse as shown in FIG. 4B. The tendency of the flexible cantilever arm section 27 to return to its original planar orientation assists the first diaphragm 13 to return to the neutral position during the pause in the vacuum signal as shown in FIG. 4A.

In a preferred embodiment, a second cutout 39 is also formed in the surface of the cantilever portion 12. This cutout 39 is similarly configured to the first cutout 37 and creates a reinforcement area 29. When the device is installed in the carburetor shown in FIG. 1, the reinforcement area 29 is situated above the inlet needle 23 of the fuel valve 26. The area above the inlet needle 23 is the point of highest fuel pressure in the diaphragm. Long time cycling of the pump can weaken the pump diaphragm in this area and cause a slight loss of fuel pressure. The reinforcement area 29 prevents excessive deformation of the first diaphragm 13 in the area above the inlet needle 23, thus preventing fuel surge in the fuel flow provided to the fuel valve 26.

As can be seen by reference to FIG. 3, the installation of a simple, easily fabricated cantilever portion can provide a number of advantages over the prior art. The one piece design can be made inexpensively and installation of the device is easily accomplished. The design as shown offers the advantages of replacing the spring as a return means for the diaphragm during the pumping action of the fuel pump and also prevents fuel surge through the use of a second reinforcement area 29 which is integrated into the cantilever portion 12.

Figure 5:
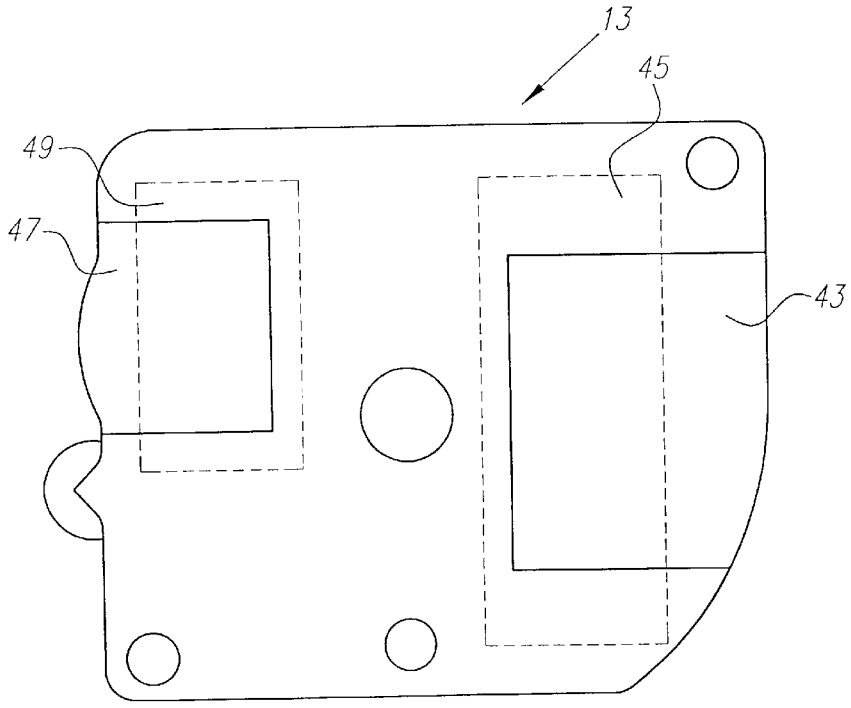
FIG. 5 is a view of a fuel pump diaphragm constructed according to the teachings of the present invention.

The present invention is not limited to the use of a second diaphragm with a cantilever portion 12 configured to completely overlay the first diaphragm 13 except for one or more cutouts 37, 39 which form cantilever arm sections 27, 29. As seen in FIG. 5, the teachings of the invention also comprehend the use of a separate cantilever arm 43 to accomplish the return of the first diaphragm 13 to the neutral position during the pause in the vacuum pulse. The cantilever arm is fixed at one end relative to the oscillation of the first diaphragm 13 and then extends over a pumping segment 45 (shown in dotted lines) of the first diaphragm 13 to assist in the return of the first diaphragm 13. A second cantilever arm 47 can also be similarly configured to reinforce the first diaphragm 13 at an inlet needle pumping segment 49 (shown in dotted lines) that prevents fuel surge in the fuel supply provided to the inlet needle 25. The use of a cantilever arm may be preferable as it is simply made and installed and requires a minimum of materials to produce.

The functioning of a single cantilever arm 43 is similar to the functioning of a cantilever arm section 27 integrated into a cantilever portion 12. The vacuum pulse will tend to draw the first diaphragm 13 inward toward the source of the pulse. Once the first diaphragm 13 is drawn inward, the separate cantilever arm 43 will also be drawn inward by the force of the vacuum pulse. The deformation in the cantilever arm 43 will be sufficient such that the natural elasticity of the arm will return the arm to its original undeformed position once the vacuum pulse is no longer applied to one side of the first diaphragm 13. Therefore, during the neutral pulse of the engine cycle, the natural elasticity of the first diaphragm 13 will be augmented by the additional resilience of the springy cantilever arm 43 so that the diaphragm 13 will oscillate between a neutral, undeformed position to a deformed, vacuum position.

Although the device is illustrated as being used on a four-cycle engine, it can also be used with a two-cycle engine to augment either the pressure or the vacuum signal so as to enhance the performance of the fuel pump. The device can also be installed on a fuel pump (not shown) which is separately formed from the carburetor assembly if desired. The fuel pump can be installed on the outside surface of the diaphragm cover, or as seen in FIG. 2, on the side surface of the carburetor main body located on the opposite side from the constantfuel chamber 28.

Although the teachings of this invention have been illustrated with specific examples and embodiments to enable one skilled in the art to make and use the invention, it is equally apparent that many more embodiments, applications and advantages are possible without deviating from the inventive concepts disclosed, described, and claimed herein. The invention, therefore, should only be restricted in accordance with the spirit of the claims appended hereto or their legal equivalent, and it is not to be restricted by the specification, drawings, or the description of the preferred embodiments.

I claim:

1. A diaphragm-type fuel pump for an engine having at least one cylinder, comprising:

a first pump diaphragm;

a cantilever portion, overlaid over the first pump diaphragm, wherein the cantilever portion is shaped to aid in the elastic return of the first pump diaphragm to a pre-determined geometry following physical deformation of the first pump diaphragm.

2. The diaphragm-type fuel pump of claim 1 wherein the cantilever portion forms an arm adapted to flex in at least one direction relative to a fixed portion of the second pump diaphragm.

3. The diaphragm-type fuel pump of claim 1 further comprising a second pump diaphragm wherein the cantilever portion comprises first and second cantilever arms integrally formed in the second pump diaphragm, the first cantilever arm extending over a first portion of the first pump diaphragm, the second cantilever arm extending over a second portion of the first pump diaphragm.

4. The diaphragm-type fuel pump of claim 1 wherein the engine is a four-stroke engine.

5. The diaphragm-type fuel pump of claim 1 wherein the engine is a two-stroke engine.

6. A diaphragm-type carburetor pump as in claim 1 wherein the diaphragm is fashioned from alcohol-resistant polyester material.

7. The diaphragm-type fuel pump of claim 1 wherein the fuel pump is integrally formed within a carburetor assembly of the engine having at least one cylinder.

8. The diaphragm-type fuel pump of claim 1 wherein the fuel pump is separately formed from a carburetor assembly of the engine having at least one cylinder.

9. A diaphragm-type fuel pump for an engine having at least one cylinder, comprising:

a pump diaphragm;

a cantilever arm having a first and a second end, wherein the first end is fixed in relation to the first diaphragm and the second end extends over a first portion of the pump diaphragm, the cantilever arm being shaped to aid in the elastic return of the first portion of the pump diaphragm to a pre-determined geometry following physical deformation of the pump diaphragm.

10. The diaphragm-type fuel pump of claim 9 further including a second cantilever arm of material having a first and second ends, wherein the first end is fixed in relation to the pump diaphragm and the second end extends over a second portion of the pump diaphragm, the cantilever arm being shaped to reinforce the second portion of the pump diaphragm so as to prevent excessive deformation of the second portion.

11. The diaphragm-type fuel pump of claim 9 wherein the engine is a four-stroke engine.

12. The diaphragm-type fuel pump of claim 9 wherein the engine is a two-stroke engine.

* * * * *

UNITED STATES PATENT AND TRADEMARK OFFICE

CERTIFICATE OF CORRECTION

PATENT NO. : 6,017,199
DATED : January 25, 2000
INVENTOR(S) : Yuzuru Yanaka

It is certified that error appears in the above-identified patent and that said Letters Patent is hereby corrected as shown below:

Column 2,
Line 43, please change "diaphragmtype" to -- diaphragm-type --.

Column 6,
Line 62, please change "constantfuel" to -- constant-fuel --.

Signed and Sealed this

Nineteenth Day of March, 2002

*Attest:*

*Attesting Officer*

JAMES E. ROGAN
*Director of the United States Patent and Trademark Office*